US010763598B1

(12) United States Patent
Chen

(10) Patent No.: US 10,763,598 B1
(45) Date of Patent: Sep. 1, 2020

(54) ELECTRIC WIRE CLIP

(71) Applicant: Xiamen Ghgm Electric Co., Ltd., Xiamen (CN)

(72) Inventor: Bingshui Chen, Xiamen (CN)

(73) Assignee: Xiamen Ghgm Electric Co., Ltd., Xiamen (CN)

( * ) Notice: Subject to any disclaimer, the term of this patent is extended or adjusted under 35 U.S.C. 154(b) by 0 days.

(21) Appl. No.: 16/454,055

(22) Filed: Jun. 27, 2019

(30) Foreign Application Priority Data

May 8, 2019 (CN) ..... 2019 1 0380922

(51) Int. Cl.

| | |
|---|---|
| ***H01R 4/48*** | (2006.01) |
| ***H01R 13/502*** | (2006.01) |
| ***H01R 11/11*** | (2006.01) |
| ***H01R 12/71*** | (2011.01) |
| ***H01R 12/51*** | (2011.01) |
| ***H01R 12/58*** | (2011.01) |
| ***H01R 9/24*** | (2006.01) |

(52) U.S. Cl.
CPC ..... *H01R 4/4818* (2013.01); *H01R 9/2416* (2013.01); *H01R 11/11* (2013.01); *H01R 12/515* (2013.01); *H01R 12/58* (2013.01); *H01R 12/716* (2013.01); *H01R 13/502* (2013.01)

(58) Field of Classification Search
CPC .. H01R 4/4818; H01R 4/4836; H01R 13/502; H01R 11/11; H01R 12/716; H01R 12/515; H01R 12/58; H01R 9/2416
USPC ..... 439/441, 266, 268
See application file for complete search history.

(56) References Cited

U.S. PATENT DOCUMENTS

| | | | | | |
|---|---|---|---|---|---|
| 6,007,369 | A * | 12/1999 | Kennedy | H01R 4/4836 | 439/268 |
| 6,022,248 | A * | 2/2000 | Wu | H01M 2/20 | 439/862 |
| 6,666,707 | B2 * | 12/2003 | Moret Codina | H01R 4/4836 | 200/51.09 |
| 8,444,443 | B2 * | 5/2013 | Schafmeister | H01R 4/4836 | 439/441 |
| 8,579,650 | B2 * | 11/2013 | Keswani | H01R 4/4818 | 439/441 |
| 8,672,703 | B2 * | 3/2014 | Fehling | H01R 4/4836 | 439/417 |
| 8,882,533 | B2 * | 11/2014 | Brandberg | H01R 13/193 | 439/441 |
| 2018/0331438 | A1 * | 11/2018 | Moser | H01R 4/48 | |

* cited by examiner

*Primary Examiner* — Gary F Paumen

(57) ABSTRACT

The present disclosure provides an electric wire clip, which includes a housing, a contact member and a pressing mechanism. The housing is provided with a mounting passage and an inserting hole communicating with the mounting passage. The pressing mechanism includes a pressing arm and a rotating shaft disposed on the pressing arm and hinged with the housing. In operation, the wire can pass through the inserting hole and be engaged with the clamping protrusion. When the wire needs to be pulled away, the driving pressing arm is rotated downwardly, and the first hook is swung downwardly to be engaged with the clamping protrusion. When rotating downwardly, the pressing arm is able to abut and drive the clamping piece to move outwardly, so that the clamping piece disengages from the wire to facilitate pulling away the wire.

9 Claims, 7 Drawing Sheets

ELECTRIC WIRE CLIP

CROSS REFERENCE TO RELATED APPLICATION

This application claims the priority benefit of Chinese Patent Application No. 201910380922.2, filed on May 8, 2019, which is hereby incorporated by reference in its entirety.

TECHNICAL FIELD

The present disclosure relates to the field of wire clips, and in particular to an electric wire clip.

BACKGROUND ART

An electrical wire clip is a wiring device for connecting a wire. The electrical wire clip includes a housing and a contact member disposed on the housing. The housing is provided with a pressing arm. During use, the wire can be inserted into the housing and electrically connected to the contact member. The pressing arm can be pressed to allow the operator to pull away the wire.

In the prior art, the pressing arm and the housing are often integrally formed. During use of the electric wire clip, the wire is frequently pulled away, often causing the pressing arm to be broken, so that the electric wire clip can no longer work properly.

SUMMARY

The present disclosure provides an electric wire clip for insertion of a wire, where the electric wire clip comprises a housing, a contact member, and a pressing mechanism.

The housing can include a mounting passage and an inserting hole communicating with the mounting passage.

The contact member can be disposed in the mounting passage, the contact member having a clamping piece for clamping the wire.

The pressing mechanism can comprise a pressing arm and a rotating shaft disposed on the pressing arm and hinged with the housing.

The wire is able to pass through the inserting hole and be engaged with the clamping piece. The pressing arm is able to rotate downwardly with the rotating shaft as a hinge center. When rotating downwardly, the pressing arm is able to abut and drive the clamping piece to move outwardly, so that the clamping piece and the wire are disengaged to facilitate pulling away the wire.

In some embodiments, the housing is provided with a clamping protrusion, and the pressing arm is provided with a first hook matching with the clamping protrusion. The pressing arm is able to rotate downwardly with the rotating shaft as a hinge center, causing the first hook to swing downwardly to be engaged with the clamping protrusion.

In some embodiments, the housing is provided with a hinge hole adapted to the rotating shaft and having an opening. The rotating shaft can be detachably disposed in the hinge hole.

In some embodiments, the mounting passage is provided with a limiting protrusion, and the pressing arm is provided with a limiting groove adapted to the limiting protrusion. The limiting protrusion can limit the angle at which the pressing arm is rotated upwardly.

In some embodiments, the pressing arm is provided with a pressing groove, and the distance between the pressing groove and the rotating shaft is larger than the distance between the limiting groove and the rotating shaft.

In some embodiments, the contact member is provided with a second hook, and the pressing arm is provided a clamping groove adapted to the second hook.

In some embodiments, the housing is provided with a limiting station adapted to the pressing arm. The limiting station can limit the angle at which the pressing arm is rotated downwardly.

In some embodiments, the contact member has a base, the clamping piece comprises a fixed section disposed on the base and a movable section disposed at the fixed section and able to swing outwardly, and the pressing arm is able to abut and drive the movable section to move outwardly.

In some embodiments, the clamping piece comprises a laterally disposed reinforcing rib, one end of the reinforcing rib being located at the fixed section, and the other end being located at the movable section.

In some embodiments, the contact member comprises a welded section arranged on the base. The welded section can pass through a PCB board and be welded to a back of the PCB board.

The electric wire clip of the present disclosure has better operating performance than the prior art electric wire clip, and the pressing arm does not break during repeated operations. Specifically, the pressing mechanism includes a pressing arm and a rotating shaft disposed on the pressing arm and hinged to the housing.

When the pressing arm is in a natural state, the pressing arm is substantially horizontally disposed or abuts against the clamping piece, at which time the wire is clamped to the clamping piece. When the wire needs to be pulled away, the pressing arm is pressed down into the housing. The pressing arm can abut and extend the clamping piece to disengage the clamping piece and the wire to withdraw the wire.

BRIEF DESCRIPTION OF THE DRAWINGS

In order to more clearly illustrate the embodiments of the present disclosure, the drawings to be used in the embodiments will be briefly described below. It should be understood that the following drawings show only certain embodiments of the present disclosure, and therefore it should not be construed as a limitation on the scope. Those skilled in the art can obtain other related drawings according to these drawings without any creative work.

DETAILED DESCRIPTION

Figure 1:
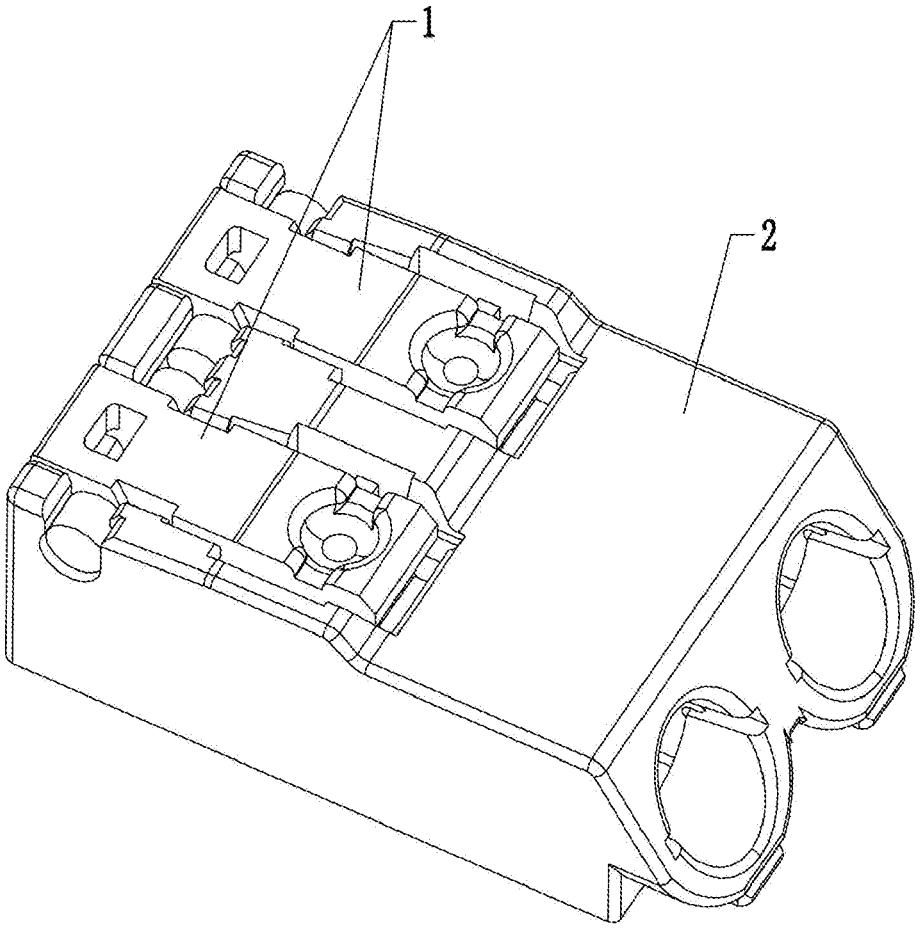
FIG. 1 is an isometric structural view of an electric wire clip according to the first embodiment of the present disclosure.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure will be further described in detail below with reference to the accompanying drawings and specific embodiments.

First Embodiment

As shown in FIG. 1 to FIG. 7, in the embodiment, an electric wire clip for plugging a wire 4 includes a housing 2 provided with a mounting passage 20 and an inserting hole 22 communicating with the mounting passage 20, a contact member 3 disposed in the mounting passage 20, the contact member 3 having a clamping piece 9 for clamping the wire 4, and a pressing mechanism 1 comprising a pressing arm 12 and a rotating shaft 11 disposed on the pressing arm 12 and hinged with the housing 2.

Figure 4:
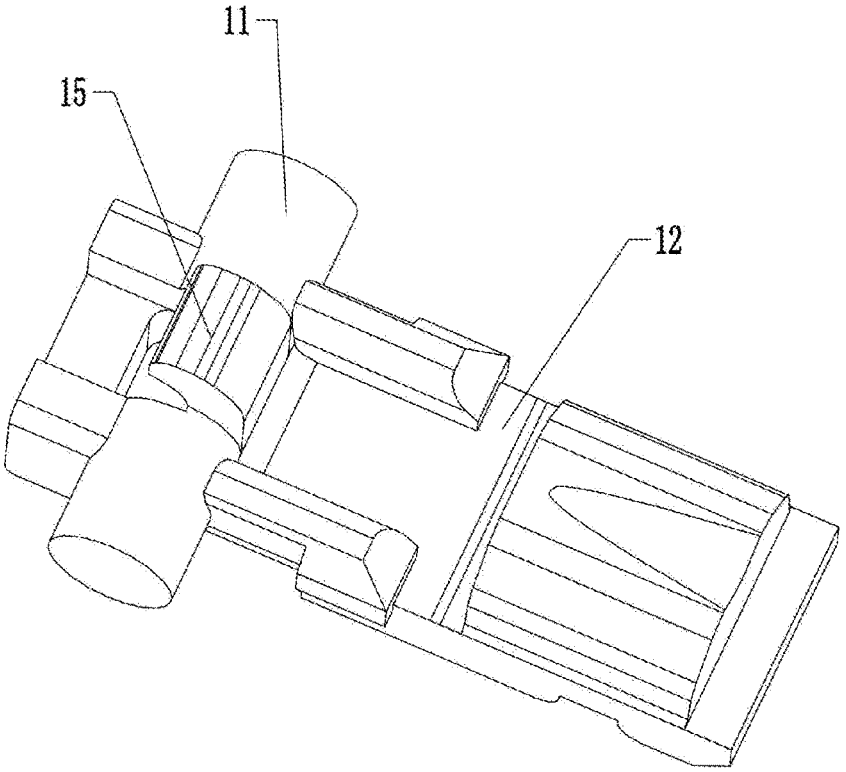
FIG. 4 is a second isometric structural view of a pressing mechanism according to the first embodiment of the present disclosure.
Figure 5:
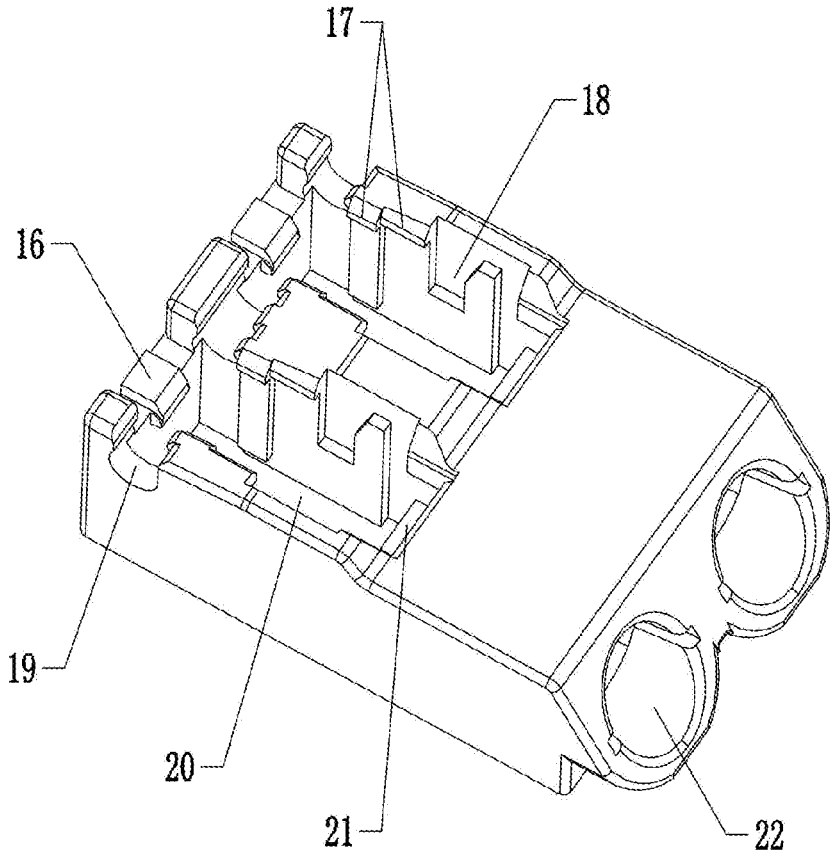
FIG. 5 is an isometric structural view of the housing according to the first embodiment of the present disclosure.

In the present embodiment, the housing 2 is provided with a clamping protrusion 16 and the pressing arm 12 is provided with a first hook 15 adapted to the clamping protrusion 16. Specifically, the wire 4 is able to pass through the inserting hole 22 and engage with the clamping piece 9. The pressing arm 12 is able to rotate downwardly with the rotating shaft 11 as a hinge center. When rotating downwardly, the pressing arm 12 is able to abut and drive the clamping piece 9 to move outwardly, so that the clamping piece 9 and the wire 4 are disengaged to facilitate pulling out the wire 4. As shown in FIGS. 4 and 5, in the present embodiment, the clamping protrusion 16 is a protrusion that is vertically disposed in the mounting passage 20, and the first hook 15 is disposed on the back of the pressing arm 12.

Figure 6:
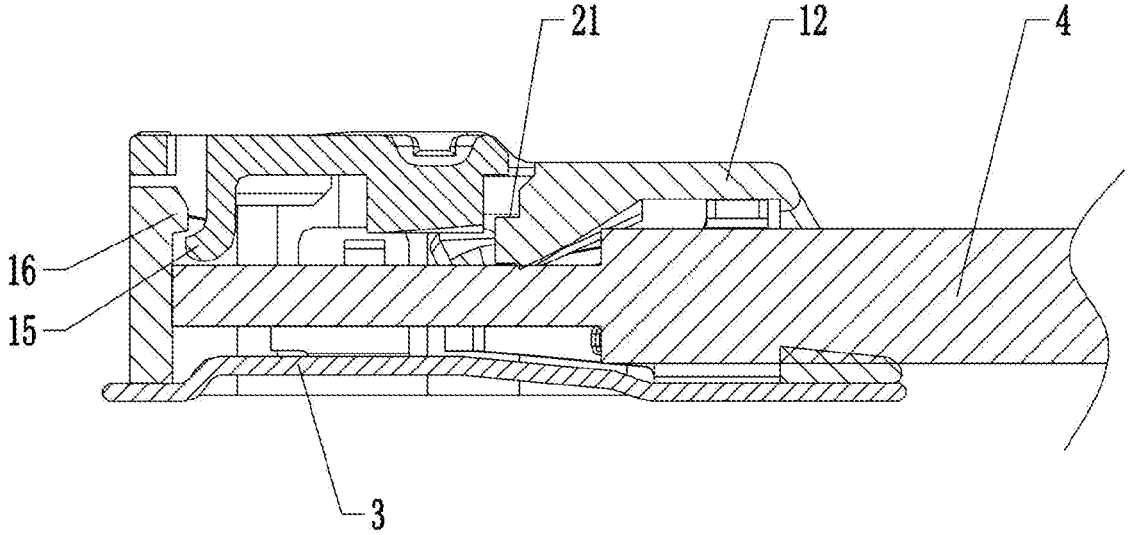
FIG. 6 is a cross-sectional structural view of the electric wire clip according to the first embodiment of the present disclosure (in which the pressing arm is not pressed down).
Figure 7:
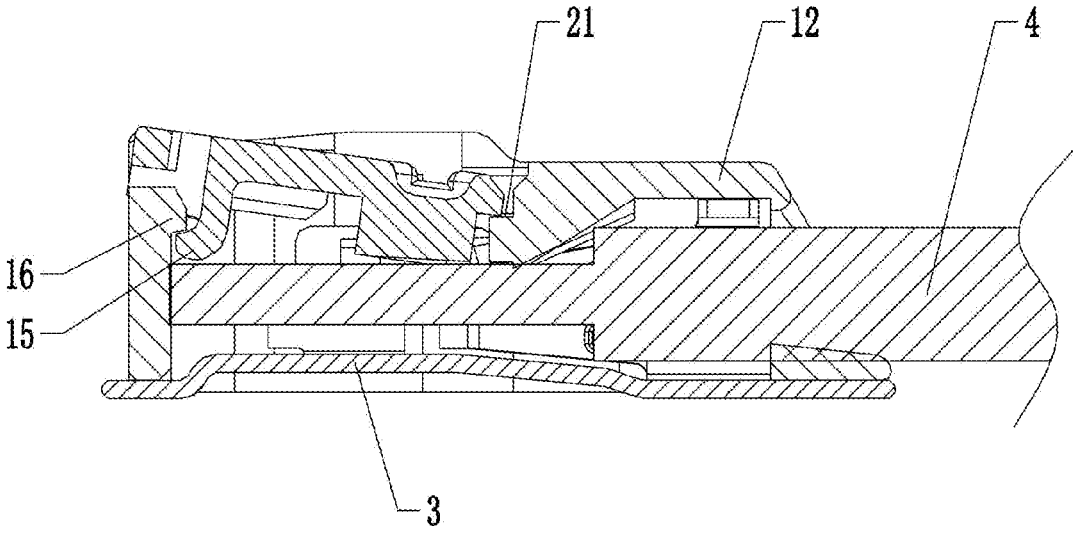
FIG. 7 is a cross-sectional structural view of the electric wire clip according to the first embodiment of the present disclosure (in which the pressing arm is pressed down).

Specifically, as shown in FIG. 6, when the pressing arm 12 is in a natural state, the pressing arm 12 is disposed substantially horizontally or abuts against the clamping piece 9, and the wire 4 is clamped to the clamping piece 9. As shown in FIG. 7, when the wire 4 needs to be pulled away, the pressing arm 12 is pressed downward, so that the first hook 15 and the pressing arm 12 are synchronously rotated downwardly, and finally the first hook 15 is hooked on the clamping protrusion 16. At the same time, when the pressing arm 12 is rotated downwardly, the clamping piece 9 is propped open by the pressing arm 12 to disengage the clamping piece 9 from the wire 4 so as to pull away the wire 4. Since the first hook 15 is caused to be hooked on the clamping protrusion 16 when the pressing arm 12 is rotated downwardly, the pressing arm 12 can be prevented from retreating and moving upwardly, thereby ensuring that the clamping piece 9 can be reliably propped open by the pressing arm 12.

In the present embodiment, the housing 2 is provided with two mounting passages 20 and two corresponding inserting holes 22, and the pressing mechanism 1 is also provided with two corresponding pressing arms 12 and two rotating shafts 11. In another embodiment, the electrical clip may be provided with other numbers of pressing arms 12 and rotating shafts 11, which are all extensions of the present disclosure and will not be described herein.

As shown in FIG. 5, the housing 2 is provided with a hinge hole 19 which is adapted to the rotation shaft 11 and has an opening, and the rotation shaft 11 is detachably disposed in the hinge hole 19. Specifically, the opening communicates with the outside, and the size of the opening needs to ensure that the remaining arc length of the hinge hole 19 is greater than half of the circumference and also that the rotation shaft 11 can be pressing fitted to the hinge hole 19. The hinge hole 19 provided with the opening ensures that the rotating shaft 11 can be conveniently disposed on the hinge hole 19, improving the assembly efficiency of the housing 2 and the rotating shaft 11.

Figure 3:
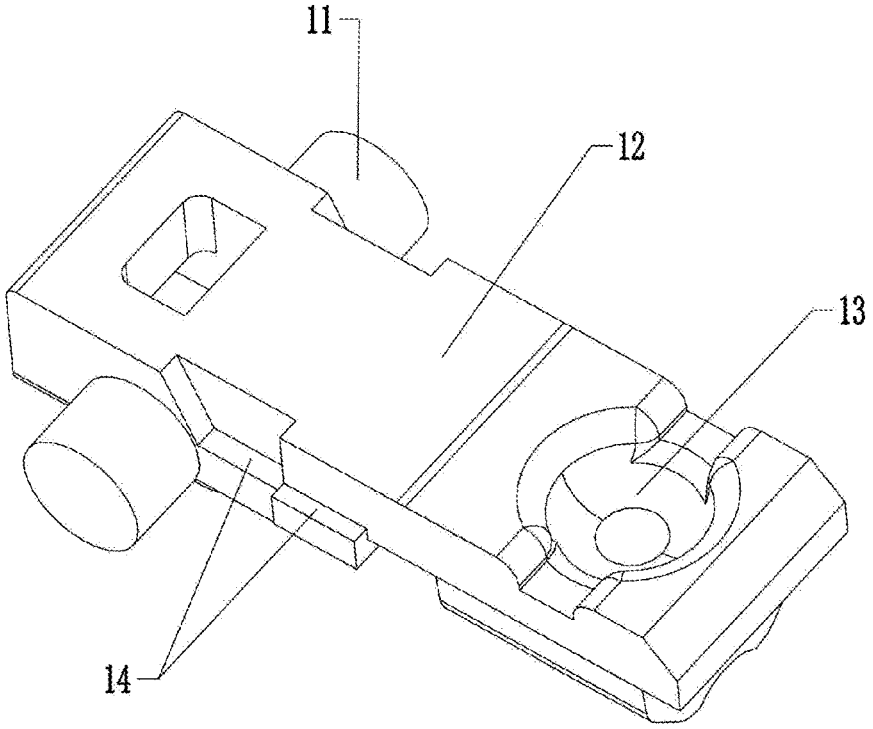
FIG. 3 is a first isometric structural view of a pressing mechanism according to the first embodiment of the present disclosure.

As shown in FIG. 3 and FIG. 5, the mounting passage 20 is provided with a limiting protrusion 17, the pressing arm 12 is provided with a limiting groove 14 adapted to the limiting protrusion 17, and the limiting protrusion 17 can limit the angle at which the pressing arm 12 is rotated upwardly. Specifically, in the present embodiment, the limiting protrusion 17 are vertically disposed on the left and right sides of the mounting passage 20 in pair. The pressing arm 12 is provided with a limiting groove 14 which is adapted to the limiting protrusion 17.

When the force causing the pressing arm 12 to rotate downwardly is cancelled, the clamping piece 9 propped open will move inwardly to a natural state, which will drive the pressing arm 12 to rotate upwardly. Since the force applied by the clamping piece 9 to the pressing arm 12 is relatively short, the pressing arm 12 would jump up. In this embodiment, the limiting protrusion 17 can catch the pressing arm 12 and limit the angle at which the pressing arm 12 is rotated upwardly.

As shown in FIG. 3, the pressing arm 12 is provided with a pressing groove the distance of which from the rotating shaft 11 is larger than the distance of the limiting groove 14 from the rotating shaft 11. Specifically, in the embodiment, the pressing groove is disposed in a shape of a straight line and is laterally disposed at the pressing arm 12, and a small circular groove is further disposed therein. During the specific operation, the operator can use a screwdriver or another tool to act on the pressing groove to cause the pressing arm 12 to rotate downward. In this embodiment, the distance between the pressing groove and the rotating shaft 11 is greater than the distance between the limiting groove 14 and the rotating shaft 11. The purpose is to prevent the pressing groove from obstructing the limiting groove 14, to ensure that the pressing arm 12 has sufficient space, and that the pressing groove can be set wider, thus facilitating the operation of the pressing arm 12.

Figure 2:
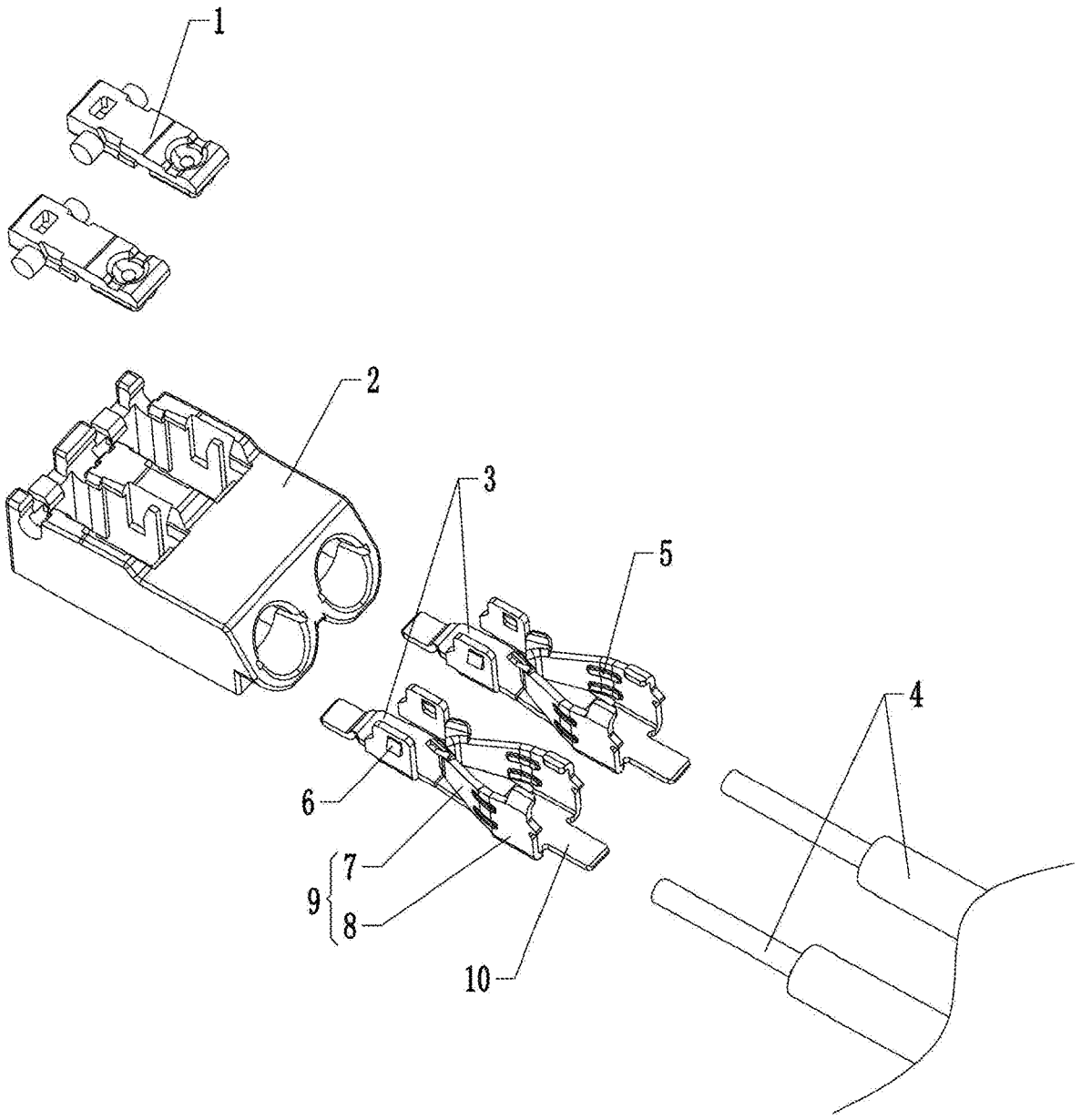
FIG. 2 is a exploded view of the electric wire clip according to the first embodiment of the present disclosure.

As shown in FIG. 2, in the present embodiment, the contact member 3 is provided with a second hook 6, and the pressing arm 12 is provided with a clamping groove 18 adapted to the second hook 6. Specifically, when the contact member 3 is disposed in the mounting passage 20, the second hook 6 can be hooked to the clamping groove 18 so as to position the contact member 3.

As shown in FIGS. 5-7, in the present embodiment, the housing 2 is provided with a limiting station 21 adapted to the pressing arm 12, which can limit the angle at which the pressing arm 12 is rotated downwardly. That is, the limiting station 21 defines the maximum angle at which the pressing arm 12 is rotated downwardly, and can prevent the angle of the downward movement of the pressing arm 12 from being too large, which would otherwise cause damage to the contact member 3.

As shown in FIG. 2, in the present embodiment, the contact member 3 has a base 10, the clamping piece 9 has a fixed section 8 disposed on the base 10 and a movable section 7 disposed on the fixed section 8 and able to swing outwardly. The pressing arm 12 is able to abut and drive the movable section 7 to move outwardly. The clamping piece 9 has a reinforcing rib 5 which is disposed laterally and recessed inwardly. The reinforcing rib 5 has one end located at the fixed section 8 and the other end located at the movable section 7. The reinforcing rib 5 can enhance the strength of the clamping piece 9, ensuring that the movable section 7 operates reliability during long-term repeated activities.

Second Embodiment

Figure 8:
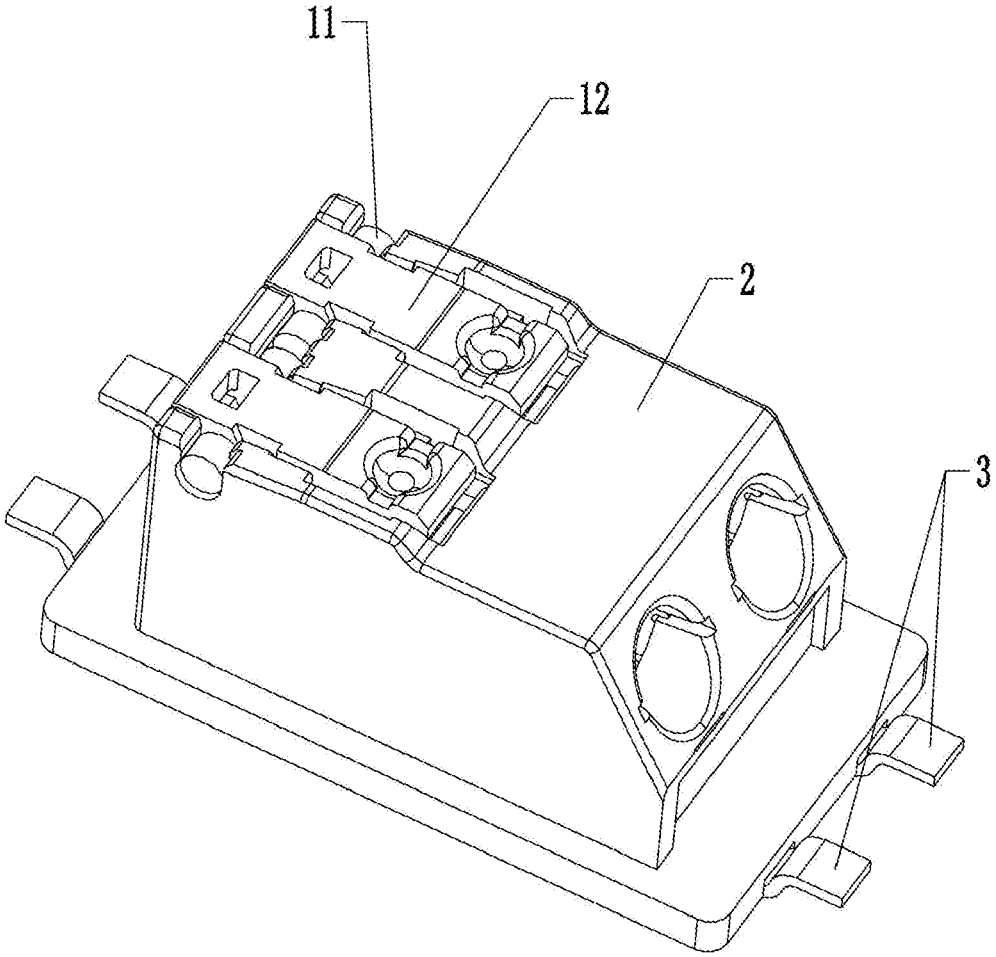
FIG. 8 is an isometric structural view of the electric wire clip according to the second embodiment of the present disclosure.
Figure 9:
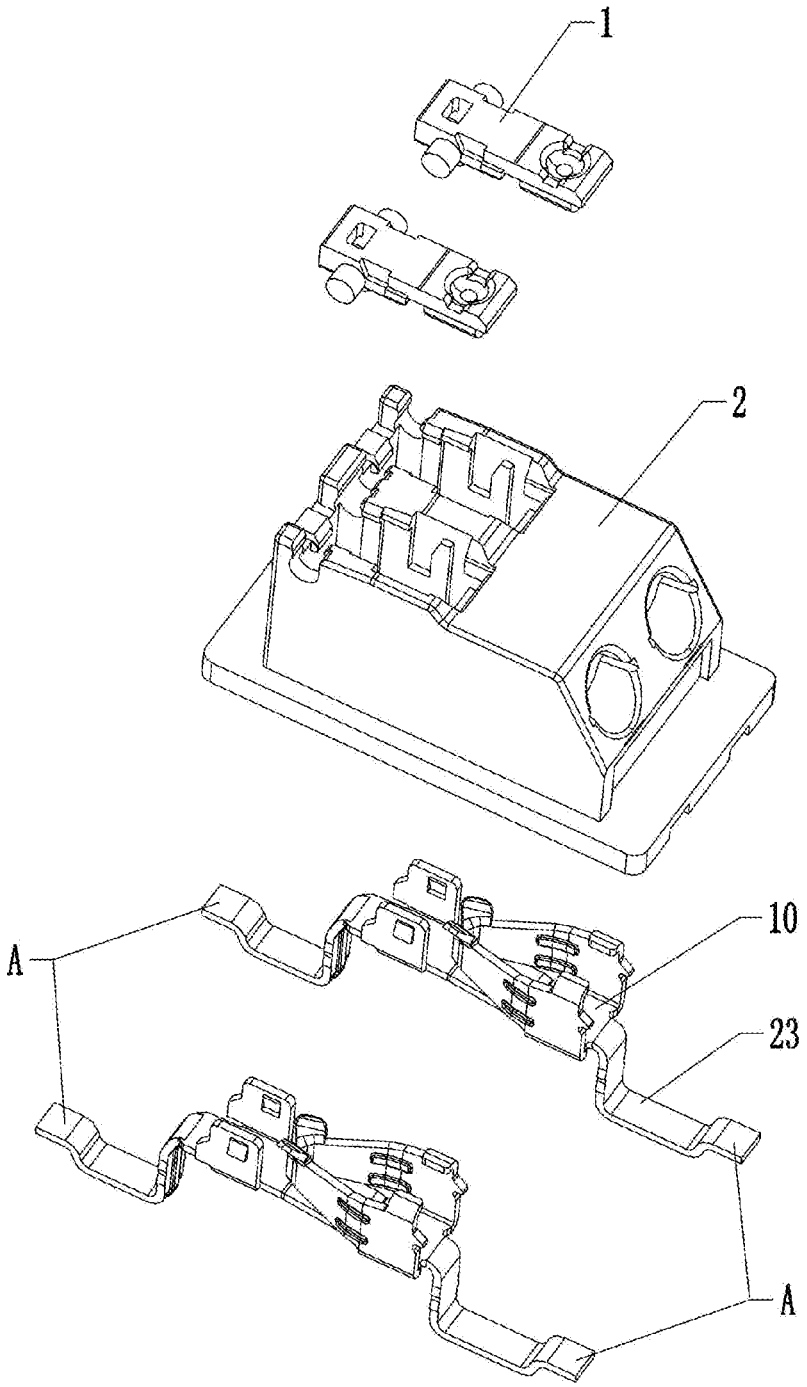
FIG. 9 is a exploded view of the electric wire clip according to the second embodiment of the present disclosure.
Figure 10:
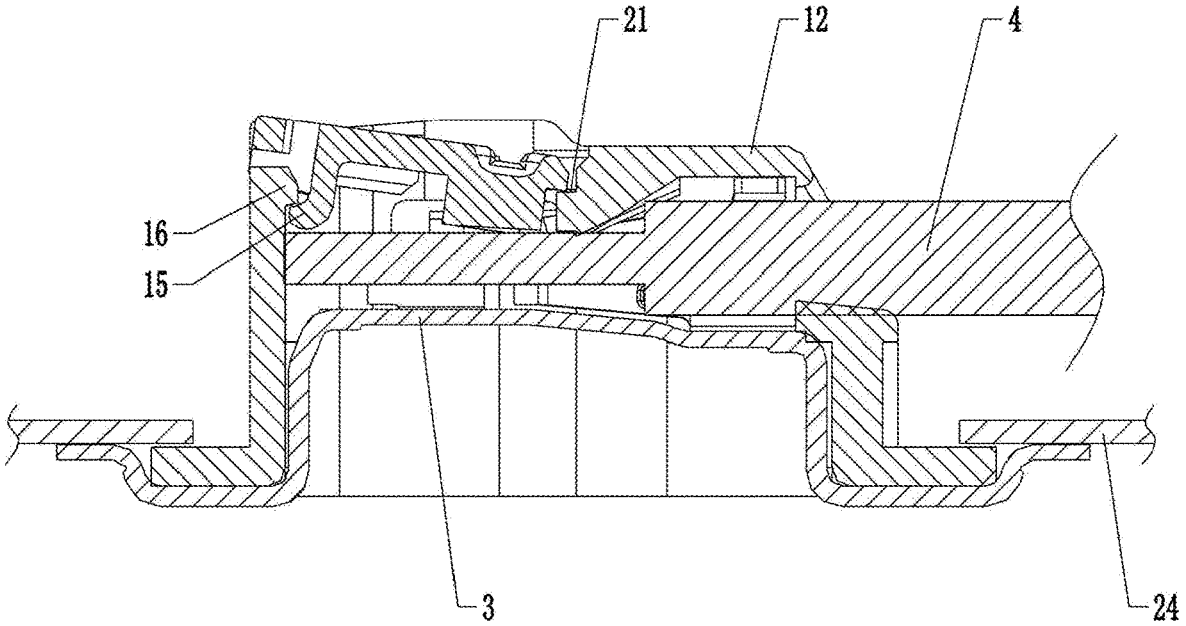
FIG. 10 is a first isometric structural view of a pressing mechanism according to the first embodiment of the present disclosure.

As shown in FIG. 8-10, in the present embodiment, the contact member 3 has a welded portion 23 disposed on the base 10, so that the contact member 3 substantially assumes an "n" shape. Preferably, the contact member 3 is shaped as a Chinese character "几". The welded portion 23 may pass through the PCB board 24 and be soldered to the back side of the PCB board 24. As shown in FIG. 9, the region A on the welded portion 23 is the portion where the welded portion 23 is soldered to the PCB board 24. In the present embodiment, the welded portion 23 is provided with a rib to enhance the strength of the welded portion 23.

Through the above arrangement, the contact member 3 in this embodiment can be soldered to the back side of the PCB board 24, so that the front side of the PCB board 24 can be made clearer without solder joint of the contact member 3. Also, the contact member 3 in this embodiment has a smaller welding surface than in prior art. In addition, in the present embodiment, other structural configurations of the housing 2, the pressing mechanism 1 and the contact member 3 are the same as those of the first embodiment, and details are not described herein again.

The above is only the preferred embodiments of the present disclosure, and is not intended to limit the present disclosure. For those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. An electric wire clip for plugging a wire, comprising:

a housing provided with a mounting passage and an inserting hole communicating with the mounting passage;

a contact member disposed in the mounting passage, the contact member having a clamping piece for clamping the wire; and a pressing mechanism comprising a pressing arm and a rotating shaft disposed on the pressing arm and hinged with the housing;

wherein the wire is able to pass through the inserting hole and engage with the clamping piece; the pressing arm is able to rotate downwardly with the rotating shaft as a hinge center; when rotating downwardly, the pressing arm is able to abut and drive the clamping piece to move outwardly, so that the clamping piece disengages from the wire to facilitate pulling away the wire;

the housing comprises a clamping protrusion, and the pressing arm comprises a first hook matching with the clamping protrusion; the pressing arm is able to rotate downwardly with the rotating shaft as a hinge center, causing the first hook to swing downwardly to engage with the clamping protrusion.

2. The electric wire clip according to claim 1, wherein the housing comprises a hinge hole adapted to the rotating shaft and having an opening, the rotating shaft being detachably disposed in the hinge hole.

3. The electric wire clip according to claim 1, wherein the mounting passage comprises a limiting protrusion, and the pressing arm is provided with a limiting groove adapted to the limiting protrusion, the limiting protrusion being able to limit the angle at which the pressing arm is rotated upwardly.

4. The electric wire clip according to claim 3, wherein the pressing arm is provided with a pressing groove, and the distance between the pressing groove and the rotating shaft is larger than the distance between the limiting groove and the rotating shaft.

5. The electric wire clip according to claim 1, wherein the contact member comprises a second hook, and the pressing arm is provided a clamping groove adapted for the second hook.

6. The electric wire clip according to claim 1, wherein the housing comprises a limiting station adapted to the pressing arm, the limiting station limiting the angle at which the pressing arm is rotated downwardly.

7. The electric wire clip according to claim 1, wherein the contact member comprises a base, the clamping piece comprises a fixed section disposed on the base and a movable section disposed at the fixed section and able to swing outwardly, and the pressing arm is able to abut and drive the movable section to move outwardly.

8. The electric wire clip according to claim 7, wherein the clamping piece comprises a laterally disposed reinforcing rib, one end of the reinforcing rib being located at the fixed section, and the other end being located at the movable section.

9. The electric wire clip according to claim 7, wherein the contact member further comprises a welded section arranged on the base, the welded section being able to pass through a PCB board and welded to a back of the PCB board.

* * * * *